United States Patent [19]

Kimura et al.

[11] Patent Number: 4,658,243

[45] Date of Patent: Apr. 14, 1987

[54] SURVEILLANCE CONTROL APPARATUS FOR SECURITY SYSTEM

[75] Inventors: Tetsuo Kimura, Tokyo; Seiichi Tanaka, Chiba; Takashi Suzuki, Tokyo, all of Japan

[73] Assignee: Nittan Company, Limited, Tokyo, Japan

[21] Appl. No.: 668,496

[22] Filed: Nov. 5, 1984

[30] Foreign Application Priority Data

| | | | |
|---|---|---|---|
| Nov. 8, 1983 | [JP] | Japan | 58-171946[U] |
| Nov. 29, 1983 | [JP] | Japan | 58-223142 |
| Dec. 16, 1983 | [JP] | Japan | 58-192963[U] |
| Dec. 26, 1983 | [JP] | Japan | 58-198578[U] |

[51] Int. Cl.[4] ..... G08B 26/00

[52] U.S. Cl. ..... 340/505; 340/518; 340/525; 340/825.07; 340/825.08; 340/825.29; 340/825.54

[58] Field of Search ..... 340/505, 518, 825.06–825.17, 340/825.54, 825.55, 825.44–825.48, 311.1, 525; 179/2 EC; 455/89

[56] References Cited

U.S. PATENT DOCUMENTS

| | | | |
|---|---|---|---|
| 3,350,687 | 10/1967 | Gabrielson et al. | 340/825.09 |
| 3,469,243 | 9/1969 | Willcox et al. | 340/825.55 |
| 3,516,063 | 6/1970 | Arkin et al. | 340/825.07 |
| 3,882,465 | 5/1975 | Cook et al. | 340/825.07 |
| 4,148,021 | 4/1979 | Watanabe | 340/505 |
| 4,468,655 | 8/1984 | Iwata | 340/825.1 |
| 4,494,111 | 1/1985 | Rocci et al. | 340/825.54 |

*Primary Examiner*—Donnie L. Crosland

*Attorney, Agent, or Firm*—Hill, Van Santen, Steadman & Simpson

[57] ABSTRACT

In a polling type surveillance control apparatus for a security system, inherent addresses are assigned to respective terminal devices such as smoke detectors, temperature sensors, gas leakage detectors, fire partitions and smoke dampers. When a self address detector in the terminal device detects a coincidence between the address signal from a central station and a preset self address, the terminal device indicates it has been accessed or energized and power control thereof may also be performed.

23 Claims, 7 Drawing Figures

SURVEILLANCE CONTROL APPARATUS FOR SECURITY SYSTEM

BACKGROUND OF THE INVENTION

The present invention relates to a surveillance control apparatus for a security system such as a fire alarm system, a smoke damper system, a gas leakage alarm system, a burglar alarm system and so on, which monitors and controls a plurality of terminal devices in a concentrated manner under the control of a central station.

In a conventional surveillance control apparatus of the type wherein a plurality of terminal devices such as a smoke detector, a temperature sensor, a photosensor, a gas detector, a fire partition and a smoke damper are connected in parallel to each other on a line extending from a central station, inherent addresses are assigned by the central station to the respective terminal devices. When a self address detector of a given terminal device detects an address signal representing the inherent address thereof and generating from the central station, the terminal device sends back a detection signal to the central station. Each terminal device also receives a control signal from the central station. This conventional system is generally called a polling system which decreases the number of lines between the central station and the terminal devices. However, since all the terminal devices are usually accessed by the central station, in a system such as a fire alarm system which requires high reliability, the entire system power must be cut off in order to prevent operation of control terminal devices such as smoke dampers or local bell units, and must be deenergized to prevent an erroneous alarm when the failure of any terminal device occurs. However, deenergization of the entire system and the local bell units results in the entire half of all system functions. Even if a fire alarm system is being installed in a construction site of a building or the like, the system cannot be operated unless the building is completely constructed. As a result, the conventional fire alarm system of this type cannot satisfy the on-the-spot needs.

In Japanese Patent Application No. 58-223142 filed Nov. 29, 1983, entitled "Surveillance Control Apparatus for Security System", incorporated herein by reference, the central station registers an address of a given terminal device and determines whether or not the given terminal device is accessed in accordance with a signal entered at a key input section. The central station refers to a registration state before each terminal device is accessed and determines whether or not this terminal device is accessed, thus solving the above-mentioned conventional problem. When a failure occurs in a terminal device, the central station registers the address of the failed terminal device, and the terminal device is not accessed. Before the respective terminal devices are accessed, the central station refers to the registration state and will not access the terminal device whose access is inhibited. The central station then accesses the next terminal device skipping the inhibited terminal device. As a result, without interrupting the operation of the system as a whole, the detection operation can be performed.

According to the apparatus proposed by the Japanese Patent Application No. 58-223142, filed Nov. 29, 1983, the breakdown state of the entire system can be prevented, and the central station can check an inhibited terminal device. However, the terminal device cannot detect whether or not it is accessed. In other words, maintenance personnel cannot know whether or not the terminal device is operated within the system, thus presenting a new problem when the reliability of the surveillance control apparatus is to be improved.

When the surveillance control apparatus is used in a gas leakage alarm system, a new problem is also presented. In a rental apartment house, gas leakage detectors operated by a commercial power source are installed in the respective apartments, and detection signals from the sensors are monitored in a concentrated monitor room. In a rental apartment house of this type, when a vacant apartment becomes available, the corresponding gas leakage detector is deenergized, and extra power consumption is prevented. However, when the power source is cut off, a new resident who moves in this apartment may often forget to turn on the power switch.

Each terminal device generates the inherent address and specific data representing whether or not the device is a fire sensor or an intrusion sensor. In addition, the terminal device converts an analog signal to a digital signal which is supplied to the central station, and also receives a control signal supplied from the central station. The terminal device having these functions comprises components most of which are formed in an integrated circuit. However, the component for setting the specific data must be a switch since data selection and updating are required. The number of contacts of the switch is increased in proportion to the number of specific data. The number of electrical parts is then increased, and the terminal device itself becomes large in size. In addition to this disadvantage, incomplete contact and accidental switching by a child or the like degrade the reliability.

SUMMARY OF THE INVENTION

It is an object of the present invention to provide a surveillance control apparatus for a security system, wherein each of the terminal devices has a display driver to be driven in response to an output from a self address detector and a display unit driven by the display driver, so that the surveillance control apparatus can accurately detect whether or not the given terminal device is accessed, i.e., whether or not the given terminal device is operated within the security system, thereby greatly improving reliability of the apparatus as a whole and wherein a driving timing of the display unit of each terminal device coincides with a timing at which the terminal device is accessed, so that the respective display units have different operation timings and will not be simultaneously operated, thereby minimizing the power source capacity requirement.

It is another object of the present invention to provide a surveillance control apparatus for a security system, wherein each of the terminal devices has a continuous controlling means consisting of a time constant circuit which has a time constant longer than an access period and which is driven in response to the output from the self address detector, and a switching means driven in response to an output from the time constant circuit. It is assumed that the surveillance control apparatus is installed in a system (e.g., the gas leakage alarm system in the rental apartment described above), and is subjected to continuous detection operation. In this case, the central station can simultaneously determine whether or not the terminal is accessed and whether or not the gas leakage detector is energized. As a result, unnecessary power consumption can be further reduced. When the new resident is moved in a vacant apartment, the maintenance personnel will not forget to energize the corresponding gas leakage detector.

It is still another object of the present invention to provide a surveillance control apparatus for a security system wherein a programmable ROM is arranged in each terminal device in the surveillance control apparatus to store specific data so as to set its inherent address, so that a large number of specific data can be selected without utilizing switch contacts, and incomplete contact and accidental switching by a child or the like will not occur, thus preventing useless data updating and hence providing a highly reliable surveillance control apparatus.

DESCRIPTION OF THE PREFERRED EMBODIMENTS

Figure 1:
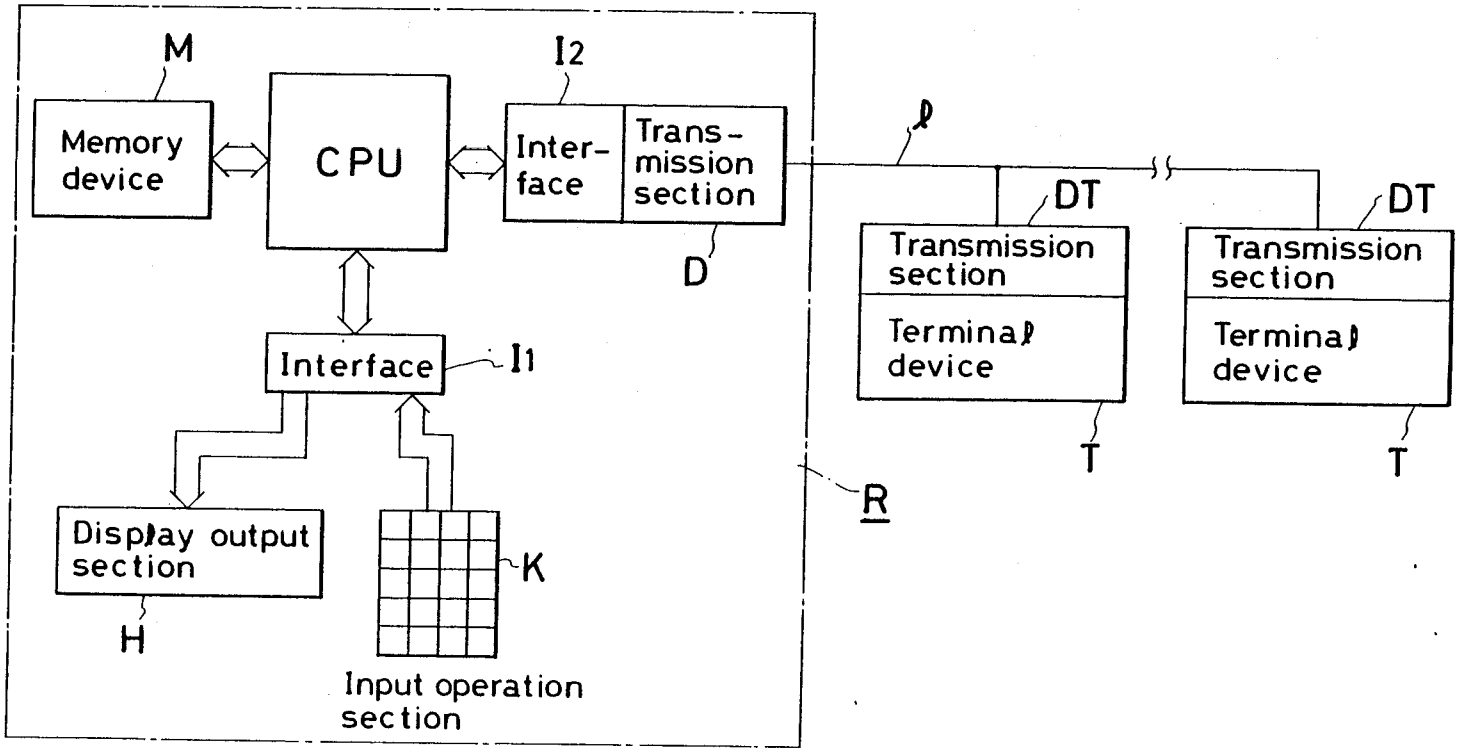
FIG. 1 is a block diagram schematically showing the overall configuration of a surveillance control apparatus for a security system according to a first embodiment of the present invention.

FIG. 1 is a block diagram of a surveillance control apparatus for a security system according to a first embodiment of the present invention. A plurality of terminal devices T are connected to a line l extending from a central station R through transmission sections DT. In the central station R, a memory device M is directly connected to a central processing unit CPU. An input operation section K and a display output section H are connected to the central processing unit through an interface I1, and a transmission section D is connected to the central processing unit CPU through an interface I2. The transmission section D is connected to the line l. The memory device M comprises buffers for storing a control program of the surveillance control apparatus and at least data representing the states of the respective terminal devices T.

Figure 2:
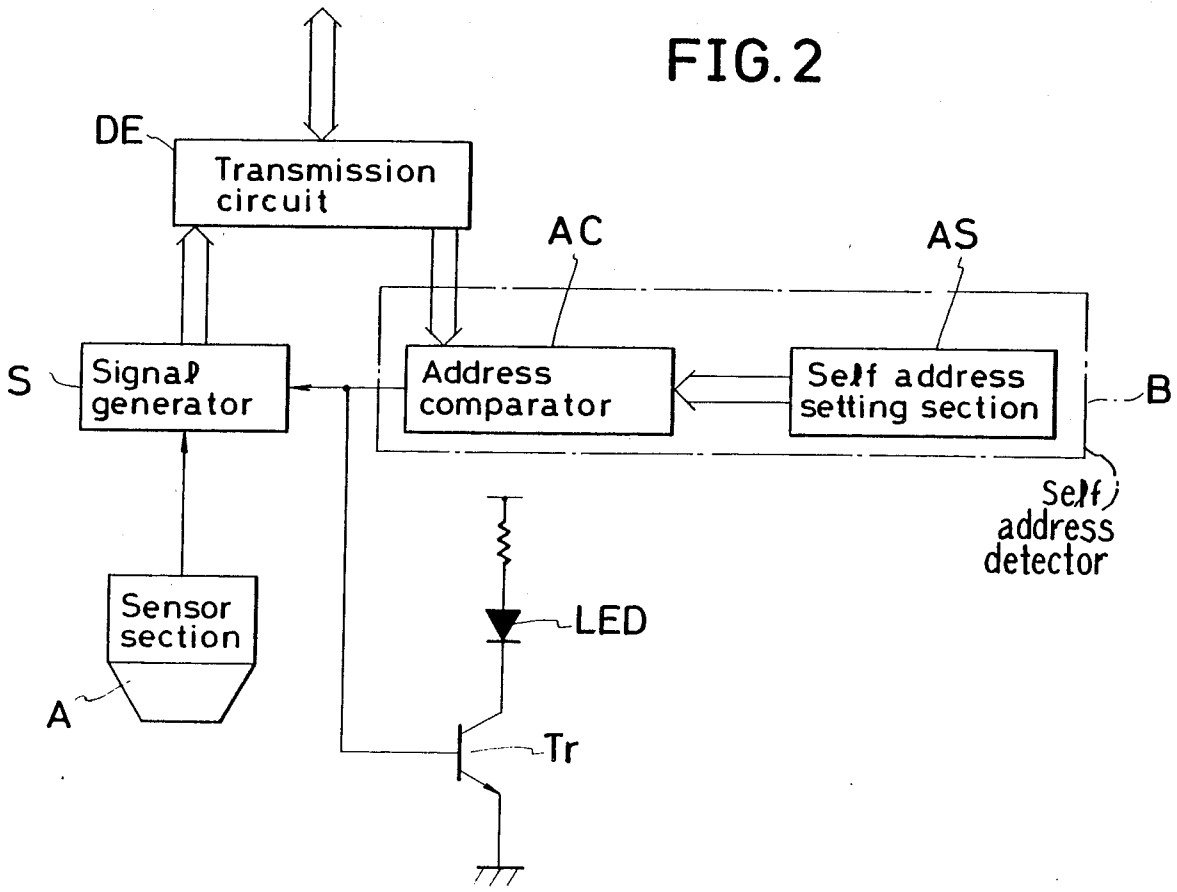
FIGS. 2 and 3 show terminal devices for the first and second embodiments of the present invention, respectively.

FIG. 2 shows a detailed arrangement of the terminal device T and the corresponding transmission section DT according to this embodiment. The terminal device T comprises a sensor section A. The sensor section A has a sensor such as a smoke detector, a temperature sensor or a gas detector which has the function of sensing physical changes in ambient conditions. An analog signal from the sensor section A is converted by a signal generator S to a digital signal. Components which are located nearer to the line l from the signal generator S are included in the transmission section DT. However, it is not essential which one of the units transmission section DT or terminal device T is to include these components. The above arrangement is made for illustrative convenience. The digital signal from the signal generator S is sent onto the line l through the transmission circuit DE. An address comparator AC compares an address signal supplied from the central station R through the transmission circuit DE via the line l with the self address present in a self address setting section AS and detects a coincidence between the address signal and the self address. A coincidence signal from the address comparator AC drives the signal generator S. The address comparator AC and the self address setting section AS constitute a self address detector B. An output from the address comparator AC is also supplied to the gate of a transistor Tr. The transistor Tr is turned on in response to this output, and a light-emitting diode LED is turned on. The light-emitting diode LED is an indicating lamp as an alarm unit. A sound generating device such as a buzzer may be used as an alarm unit in place of the light-emitting diode. The transistor TR serves as a display driver. However, a relay circuit or the like may be used for this purpose.

In the surveillance control apparatus having the arrangement described above, the central processing unit CPU causes the transmission section D to sequentially set address data through the interface I2 in accordance with the prestored contents in the memory device M, and accesses addresses of the respective terminal devices. When a terminal device which is not to be accessed is present, an inhibit command is entered at the input operation section K and is supplied to a terminal device data storage location in the buffer in the memory device M. The central processing unit CPU checks the registration or storage state of this buffer every time the respective terminal devices are accessed. Therefore, an address signal is not supplied to the inhibited terminal device.

The address signal transmitted through the line l is received by the corresponding address comparator AC in each terminal device T through the corresponding transmission section DE. The address comparator AC compares the input address signal with the self address preset in the self address setting section AS. When the address comparator AC detects a coincidence between the address data and the self address, the comparator AC generates a detection signal. This detection signal drives the signal generator S which then converts to the digital signal the analog signal generated from the sensor section A. This digital signal is sent out onto the line l through the transmission circuit DE. At the same time, the coincidence signal from the address comparator AC is supplied to the base of the transistor Tr. In response to this signal, the transistor Tr is turned on, and then the light-emitting diode LED is turned on. When the light-emitting diode LED is kept on, the maintenance personnel or the new resident can check that the terminal device T is accessed and is properly operating in the surveillance control apparatus, thereby improving the reliability of the apparatus. In this embodiment, a light-emitting diode is used as the alarm device. However, the device may comprise a sound generating device such as a buzzer.

Every time each terminal device T is accessed, the alarm device is driven.

In the above embodiment, the alarm device is driven while the address comparator AC generates the detection signal for a short period of time. In this case, it may be difficult to check whether the corresponding terminal device is properly operated. In order to eliminate this drawback, a circuit for elongating a pulse width of the output from the address comparator AC can be added to properly check that the terminal device is normally operated.

Figure 3:
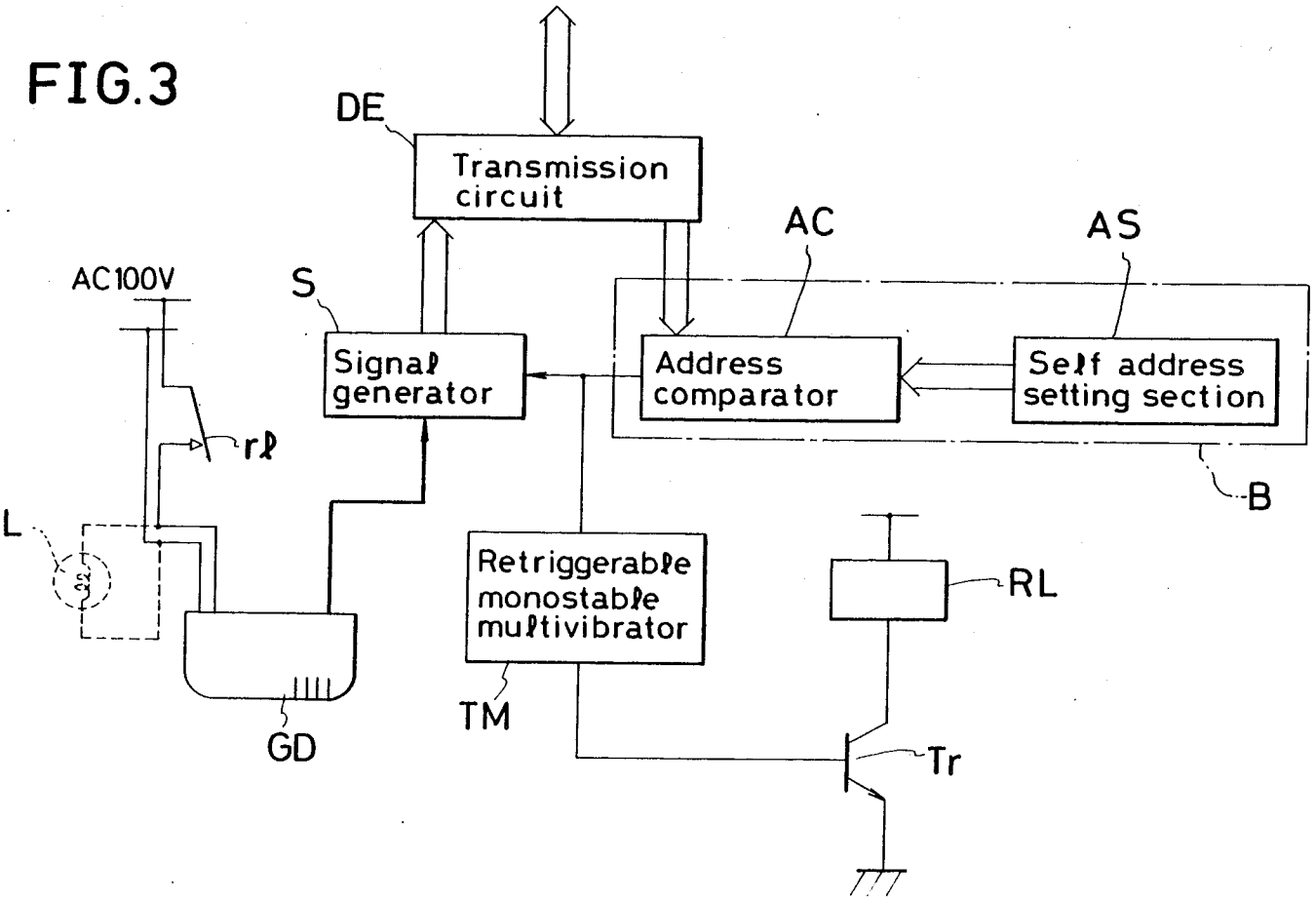

FIG. 3 shows a terminal device T and a corresponding transmission section DT according to a second embodiment of the present invention. The terminal device T comprises a gas leakage detector in the same manner as in the first embodiment. Referring to FIG. 3, a signal generator S converts to a digital signal an analog signal generated from an environmental parameter measuring element such as a gas detector GD. Components which are located nearer to a line l from the signal generator S are included in the transmission section DT. It is not essential to include the components in the transmission section DT or the terminal device T. The above arrangement is made for illustrative convenience. The signal from the signal generator S is sent out onto the line l through a transmission circuit DE. An address comparator AC compares an address signal supplied from the central station R through the transmission circuit DE via the line l and the self address preset in a self address setting section AS. When the address comparator AC detects a coincidence between the address signal and the self address, the comparator AC generates a coincidence signal. This coincidence signal drives the signal generator S. The address comparator AC and the self address setting section AS constitute a self address detector B. An output from the address comparator AC is also supplied to a retriggerable monostable multivibrator TM serving as a time constant circuit. An output from the monostable multivibrator TM drives a transistor TR. A relay RL is connected to the collector of the transistor R. When the transistor TR is turned on, the relay RL is energized. A power source voltage (AC 100 V) is supplied to the gas detector GD as the sensor section through a normally opened contact rl of the relay RL. A pulse width (i.e., the time constant of the time constant circuit) of the output from the retriggerable monostable multivibrator TM is longer than an access period.

In the surveillance control apparatus having the arrangement described above, the central processing unit CPU causes the transmission section D to sequentially set address data through an interface I2 in accordance with the prestored contents in the memory device M and accesses addresses of the respective terminal devices T. When a terminal device T which is not to be accessed is present due to the presence of a vacant room, an inhibit command is entered at the input operation section K and is supplied to a terminal device data storage location in the buffer in the memory device M. The central processing unit CPU checks the registration or storage state of this buffer every time the respective terminal devices are accessed. Therefore, an address signal is not supplied to the inhibited terminal device.

The address signal transmitted through the line l is received by the corresponding address comparator AC in each terminal device T through the corresponding transmission section DE. The address comparator AC compares the input address signal with the self address preset in the self address setting section AS. When the address comparator AC detects a coincidence between the address data and the self address, the comparator AC generates a detection signal. This detection signal drives the signal generator S which then converts to the digital signal the analog signal generated from the sensor section A. This digital signal is sent out onto the line l through the transmission circuit DE. At the same time, the coincidence signal from the address comparator AC is supplied to retrigger the monostable multivibrator TM. In this manner, every time the terminal device T is accessed, the monostable multivibrator TM is retriggered. Since the pulse width of the output from the monostable multivibrator TM is longer than the access period, the monostable multivibrator TM continuously drives the transistor Tr when the access is performed within each pulse width. Therefore, the relay RL is continuously energized to keep closed the normally opened contact, and thus the power source voltage is continuously applied to the gas detector GD. The retriggerable monostable multivibrator TM, the relay RL energized in response to the output from the multivibrator TM, and the normally opened contact rl form a continuous controlling means in the detection section.

However, the inhibited terminal device registered in the central station R will not be accessed. The corresponding monostable multivibrator TM will not be retriggered. When the pulse width period of the output generated from this multivibrator TM has elapsed, the corresponding RL is deenergized, and the normally opened contact rl is opened to deenergize the gas detector GD.

In the surveillance control apparatus for a security system of the present invention, each terminal device comprises a continuous controlling means formed of a time constant circuit which has a time constant longer than an access period and which is driven in response to the output from the self address detector. It is also formed of a switching means driven in response to an output from the time constant circuit. Assume that the surveillance control apparatus is installed in a system (e.g., the gas leakage alarm system in the rental apartment described above) subjected to continuous detection operation. In this case, the central station can simultaneously determine whether or not the terminal is accessed and whether or not the gas leakage detector is energized. As a result, unnecessary power consumption can be further reduced. When a new resident is moved in a vacant apartment, he or the maintenance personnel will not forget to energize the corresponding gas leakage detector.

As indicated by the dotted lines in FIG. 3, when an indicator lamp L is connected in parallel with the gas detector GD across the power source (AC 100 V), the indicator lamp L is continuously turned on while the normally opened contact rl of the relay RL is closed. Therefore, the maintenance personnel can visibly check that the power source voltage is applied to the gas detector GD and that the terminal device is properly accessed, thus further improving the reliability of the surveillance control apparatus.

Figure 5:
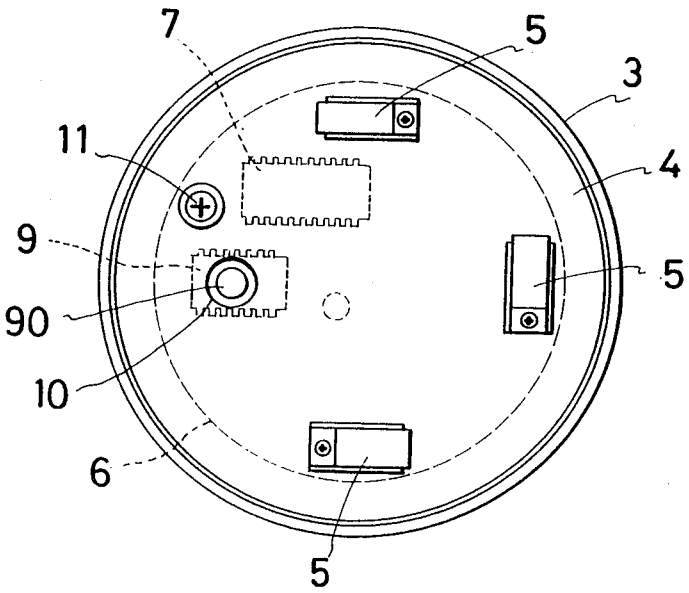
FIGS. 4 and 5 are respectively a partially cut-away side view and a rear view of the terminal device.
Figure 4:
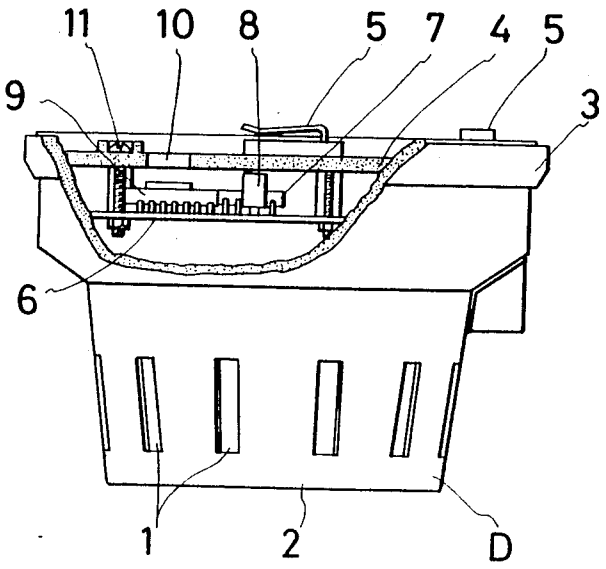

FIGS. 4 and 5 show a detailed configuration of the self address setting section. In this case, the terminal device serves as a fire detector.

A detailed description of the fire detector will not be made. The fire detector may comprise an ionization or photoelectric smoke or temperature detector. The detection section is housed in a cover 2 having slits 1 for receiving an atmospheric gas. The proximal portion of the cover 2 serves as a base 3. The cover 2 holds a signal generator for generating a signal from the detection section and a transmission section for exchanging data with the central station. Fitting pieces 5 are mounted on a bottom plate 4 of the base 3 to fit with holding metal pieces of a fixed base mounted on a ceiling surface. The transmission section comprises an integrated circuit 7, circuit elements 8 such as resistors and capacitors, and a programmable read-only memory (to be referred to as an EPROM hereinafter) 9 which are mounted on a printed circuit board 6. The EPROM 9 comprises any type of ROM such as a ROM erased upon irradiation of ultraviolet rays, and a ROM erased upon application of a high voltage. In the self address setting section shown in FIGS. 4 and 5, the EPROM 9 comprises a ROM erased upon irradiation of ultraviolet rays. A through hole 10 is formed in the bottom plate 4 of the base 3 at a position corresponding to a window 90 through which the EPROM 9 is programmed. In addition, a terminal 11 is provided to receive a high voltage.

In the fire detector having the arrangement described above, when addressing is performed, address and data signals are supplied thereto while a high voltage is being applied to a terminal 11, thereby writing a data signal at the address represented by the address signal. A light-shielding seal or cover is formed on the through hole 10 formed in the bottom plate 4 of the base 3 to prevent the storage contents of the EPROM 9 from damage.

In order to erase the storage content of the EPROM 9, the light-shielding cover is removed from the through hole 10, and the EPROM is exposed with the ultraviolet rays.

The write/erasure operations described above are performed in the following manner. A high voltage is applied to the terminal 11, the address and data signals are supplied to the fitting pieces 5, and the ultraviolet rays irradiate the EPROM 9 through the through hole 10. The fire detector need not therefore be disassembled, and direct handling need not be performed. Therefore, a ROM eraser and writer can be used integrally with the fire detector to perform the erasure/write operations. For example, the fixing base having the holding metal pieces which are respectively fitted with the fitting pieces of the fire detector is mounted on the housing, and connectors for the ultra-violet source and the high voltage source are connected to the positions corresponding to the through hole of the fixing base and the terminal. At the same time, a ROM writer can be built into the housing. Such eraser and writer EPROM circuits are well known to those skilled in this art and therefore have not been shown in greater detail.

In the above embodiment, the EPROM performs only addressing. However, data for distinguishing the ionization type fire detector from the photoelectric fire detector may be stored in the EPROM.

The address comparator AC and self address setting section AS are formed of circuit EWD106 of Fuji Electronic Co., Ltd. Such a component is also used in related applications, U.S. Ser. No. 546,109, filed Oct. 27, 1983 and U.S. Ser. No. 546,108, filed Oct. 27, 1983, both incorporated herein by reference, which both also disclose a main unit for addressing sensor terminals.

Figure 6:
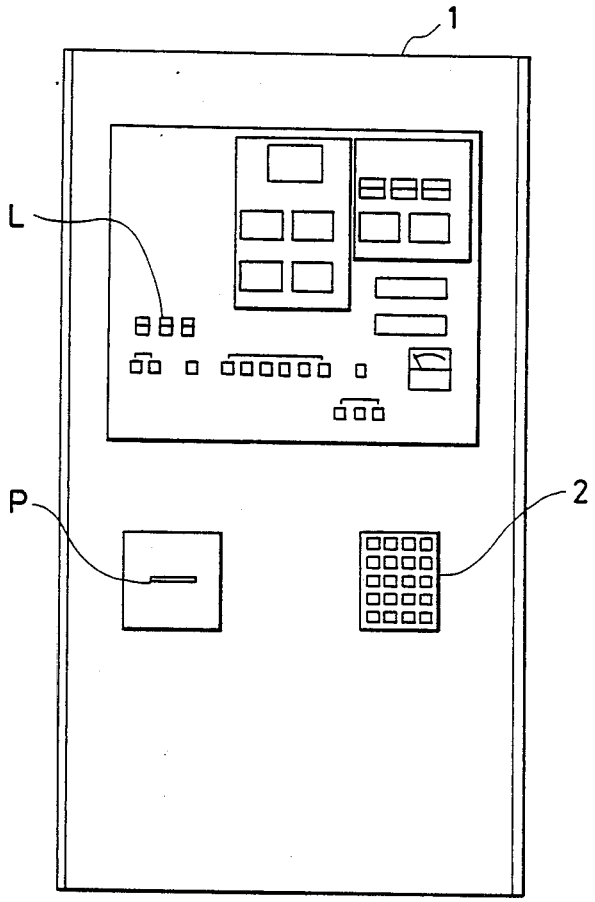
FIG. 6 shows an outer appearance of a central station R in FIG. 1.
Figure 7:
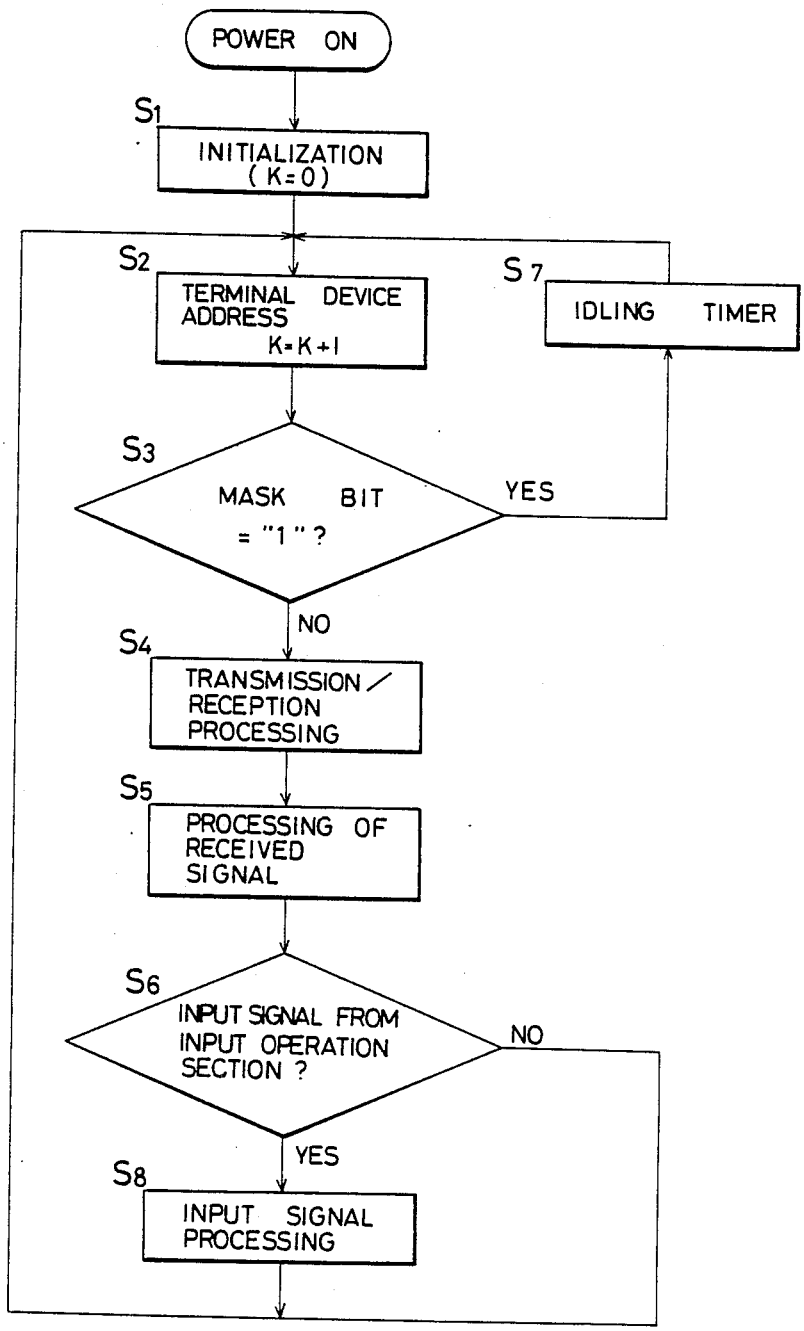
FIG. 7 is a flow chart for explaining the operation of the apparatus shown in FIG. 1.

The program flow chart for operation of the system shown in FIGS. 1, 2, and 3 of the instant case is disclosed in the previously mentioned Japanese Patent application No. 58-223142. FIGS. 1, 6, and 7 will now be referred to in discussing the system disclosed in this Japanese Patent application.

FIG. 1, as indicated previously, is a block diagram of the surveillance control apparatus for a security system according to the present invention. A plurality of terminal devices T are connected to a transmission line extending from a central station R through respective interfaces DT parallel to each other. The central station R comprises a central processing unit CPU as a major unit. A memory device M is connected to the central processing unit CPU. A display output section H and an input operation section K are connected to the central processing unit CPU through an interface I1. A transmission section D is connected the CPU through an interface I2. The transmission section D is connected to the transmission line l. The memory device M stores a control program for controlling the overall operation of the apparatus. The memory device M has buffers for storing the states of the respective terminal devices T. The outer appearance of the central station R is illustrated in FIG. 6. A keyboard 2 which serves as an input operation section K, and indicator lamps L and a printer P serving as the display output section H, are arranged on the upper surface of a case 1.

The operation of the surveillance control appartus having the arrangement described above will be described with reference to the flow chart in FIG. 7.

When the apparatus is powered, various buffers in the memory device M are initialized in step S1. A call terminal device address K is set at address 0. In step S2, the call terminal device address K is incremented by one to set address 1. In step S3, a mask bit representing whether or not the terminal device data at address 1 is accessed, is checked in the buffer in the memory device M. When this mask bit is not set at logic "1" (NO) in step S3, the flow advances to step S4. However, if YES in step S3, the central processing unit CPU detects that the access of this terminal device is inhibited, and the flow advances to step S7. In step S7, an idling timer to provide an idling time for matching with other operations, counts a preset time. The flow then returns to step S2, and the address for the next terminal is set. When the mask bit is not set at logic "1" in step S3 and it is determined that the terminal is to be accessed, the corresponding terminal device address, command data, and the like are set in the transmission section D, and the transmission is started. The central processing unit CPU waits to receive data from the transmission section D and the received data is processed in step S5. In step S5, the received data are compared, any other operation is performed, and appropriate display is performed in the display output section H, if needed. The terminal device address is included in the contents displayed in the display output section H. Maintenance personnel can take proper action upon a visual check. For example, when a terminal device address is displayed, data for representing inhibition of the terminal device address is entered at the input operation section K. This operation is performed in steps S6 and S8. The central processing unit CPU checks in step S6 whether or not the data is entered at the input operation section K. If NO in step S6, the flow returns to step S2, and the next terminal device address is set. However, if YES in step S6, the flow advances to step S8. The operation is performed in step S8 in accordance with the type of input. When the operation in step S8 is the inhibition operation for the terminal device, the mask bit for the non-accessed terminal device goes low in the corresponding buffer in the memory device M. A display representing a currently access-inhibited terminal device is performed in the display output section H. In this case, the corresponding address can also be displayed. When the call is restarted, the corresponding mask bit goes high, and the display at the display output section H is cancelled. When such an operation is performed, the flow returns to step S2, and the next terminal device address is set. The operations in steps S3 to S8 are performed for the next terminal device, as needed. When the address is updated and has reached the end address, the address returns to the start address. When the normal operation procedure is performed, an additional operation for updating the end address to the start address is required. However, in this embodiment, an operation is utilized wherein the content of the register returns to zero when it exceeds the maximum value and the address preset value does not exceed the maximum value. Therefore, the additional operation described above need not be performed in this embodiment.

According to the surveillance control apparatus of the present invention, the central station registers an address of the terminal in response to a signal from an input operation section and whether or not the device is accessed. The registration state is displayed on the display unit, if necessary. The central station also determines whether or not the terminal is accessed in accordance with the registration state thereof, thereby solving the conventional problem. Even if the terminal device is malfunctioning, the apparatus as a whole need not be stopped, thereby improving the reliability of the apparatus. The call inhibition and the restart can be easily performed at the input operation section. The apparatus can be effectively used in a construction site of a building or the like in accordance with the degree of progress. The data transmission is interrupted in accordance with the logic state of the mask bit, so that the idling time of the central processing unit is increased to perform a multiple program operation, resulting in convenience. When the access or call inhibition occurs, the inhibition state can be indicated by indicator lamps L or printed at the printer P. As a result, maintenance personnel can perform proper countermeasures.

Although various minor changes and modifications might be proposed by those skilled in the art, it will be understood that we wish to include within the claims of the patent warranted hereon all such changes and modifications as reasonably come within our contribution to the art.

I claim as my invention:

1. A surveillance control system for a security system in which data signals are exchanged between a central station and a plurality of terminal devices, comprising:

the terminal devices being connected in parallel with each other to a common line extending from said central station;

each terminal device having a self address detector means for detecting whether a received address signal coincides with a self address stored in the detector means unique for each respective terminal device, the detector means then creating an output;

each terminal device having a display driver means for responding to said output from said self address detector means each and every time when address coincidence occurs, and a display unit driven by said display driver means;

said central station having means for generating address signals corresponding to the addresses of the plurality of terminal devices; and said central station having means for storing an address of a terminal device which is not to be accessed and for selectively not addressing said terminal device when the other terminal devices are being addressed, whereby through observation of the display unit at the terminal device it can readily be determined whether the terminal device is being accessed by the central station.

2. A system according to claim 1 wherein said display unit comprises an indicator lamp and means are provided for maintaining the lamp in an illuminated condition for a time period longer than a time period that said output is present from the self address detector means.

3. A system according to claim 1 wherein the detector means in each of said plurality of terminal devices has a programmable read-only memory means for storing specific data which designates said unique self address thereof.

4. A system according to claim 1 wherein said self address detector means comprises a self address setting section means for storing a unique address for a given terminal and an address comparator means for comparing the terminal unique address with incoming addresses from the central station so as to determine the coincidence.

5. A surveillance control system for a security system in which data signals are exchanged between a central station and a plurality of terminal devices during a defined access period for each device, comprising:

the terminal devices being connected in parallel with each other to a common line extending from said central station;

each terminal device having a self address detector means for detecting whether a received address signal coincides with a self address stored in the detector means unique for each respective terminal device, the detector means then creating an output based on each coincidence;

each terminal device having a controlling means directly responsive to each of the outputs from said self address detector means and including a time constant circuit means for providing a time constant longer than the access period, said controlling means having an output which drives a switching means;

said switching means connecting to at least one of an indicating device or an environmental parameter detecting device; and said central station having means for generating address signals corresponding to the addresses of the plurality of terminal device, whereby said switching means is activated at the terminal device and is held in its switched condition for a given time constant whenever the terminal device is accessed.

6. A system according to claim 5 wherein each terminal device has a programmable read-only memory means for storing specific data which designates said unique self address thereof.

7. A system according to claim 5 wherein said switching means is connected to switch on a security detecting element for a period corresponding to said time constant.

8. A system according to claim 7 wherein an indicator means is connected to also be switched on when the security detecting element is switched on.

9. A system according to claim 5 wherein said central station has means for storing an address of a terminal device which is not to be accessed and for not addressing said terminal device when the other terminal devices are being sequentially addressed.

10. A system according to claim 5 wherein said self address detector means comprises a self address setting section means for storing a unique address for a given terminal and an address comparator means for comparing the terminal unique address with incoming addresses from the center station so as to determine the coincidence.

11. A system according to claim 5 wherein said switching means activates an indicator means for indicating that the terminal device is being accessed, said indicator means remaining on for the given time constant.

12. A surveillance contol system for a security system in which data signals are exchanged between a central station and a plurality of terminal devices and wherein an inhibit command at the central station may be employed to prevent a data signal exchange with given terminal devices, comprising:

the terminal devices being connected in parallel with each other to a common line extending from said central station;

each terminal device having a self address detector means for detecting whether a received address signal coincides with a self address stored in the detector means, the detector means then creating an output;

said detector means having a programmable read only memory means for storing the self address;

said central station having means for generating address signals corresponding to the addresses of the plurality of terminal devices;

said central station having means for storing an address of a terminal device which is not to be accessed and for automatically not addressing the terminal device not to be accessed during the addressing;

at each terminal device providing said element as at least one of the elements selected from the group consisting of indicating device and environmental parameter detector device so that such element is activated only when the terminal device is accessed.

13. A system according to claim 12 wherein said element being controlled is the indicator means which permits an observer at the terminal device to determine that the device is being accessed.

14. A system according to claim 13 wherein said element comprises switching means for activating the environmental parameter measuring means only when the terminal device is accessed.

15. A system according to claim 14 wherein the environmental parameter measuring means comprises a gas detector.

16. A system according to claim 12 wherein said element being controlled is the environmental parameter measuring means and also the indicating means so that the environmental parameter measuring means is activated only when the device is accessed and the indicator means indicates only when the terminal device is accessed so that an observer viewing the terminal device can detect such access.

17. A system according to claim 12 wherein the controlling means includes a time constant circuit means to ensure a continuous activation of said element for a given time period after access.

18. A system according to claim 12 wherein a programmable read-only memory means is provided for storing a unique self address in each terminal device.

19. A method for operating a surveillance control system wherein a central station generates address signals for various terminal devices and skips over addresses of those terminal devices for which an input command has been made to inhibit access to the corresponding terminal device, and wherein data signals are exchanged between the central station and the respective terminal devices by use of a self address detector in each terminal device which detects whether a received address signal coincides with a self address stored in the detector, comprising the steps of:

providing in each terminal device a controlling means responsive to the output from the detector so as to control an element at the terminal device every time the terminal device is accessed; and at each terminal device providing said element as at least one of the elements selected from the group consisting of indicating device and environmental parameter detector device so that such element is activated only when the terminal device is accessed.

20. A system according to claim 19 wherein the memory means comprises an EPROM which is programmed for its unique address through circuit means for applying a high voltage at the location of the terminal device, and is erased through ultraviolet ray erasure means provided at the terminal device.

21. A method according to claim 19 including the step of providing said element as the indicating device so that an observer observing the terminal device can observe whether or not it is being accessed and providing a delay means so that the indicating device continues to be activated for a predetermined time period after the terminal device has been accessed so that an observer can easily observe the indicating device even though the output from the detector is no longer present.

22. A system according to claim 21 wherein the erasure means includes a light access aperture means at the terminal device which ultraviolet rays can be selectively provided to expose the EPROM.

23. A method according to claim 19 including the step of providing the element as the environmental parameter detector device so that the detector device is activated only when the terminal device is accessed.

* * * * *